US010022799B2

(12) United States Patent
Okabe et al.

(10) Patent No.: US 10,022,799 B2
(45) Date of Patent: Jul. 17, 2018

(54) SILVER POWDER AND METHOD FOR PRODUCING SAME

(71) Applicant: SUMITOMO METAL MINING CO., LTD., Tokyo (JP)

(72) Inventors: Yoshihiro Okabe, Ehime (JP); Kenya Ito, Ehime (JP); Shuuji Okada, Ehime (JP); Masamu Nishimoto, Ehime (JP); Akihiro Murakami, Ehime (JP); Shintaro Ishikawa, Ehime (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 793 days.

(21) Appl. No.: 14/380,828

(22) PCT Filed: Feb. 22, 2013

(86) PCT No.: PCT/JP2013/054546
§ 371 (c)(1),
(2) Date: Aug. 25, 2014

(87) PCT Pub. No.: WO2013/125686
PCT Pub. Date: Aug. 29, 2013

(65) Prior Publication Data

US 2015/0017465 A1 Jan. 15, 2015

(30) Foreign Application Priority Data

Feb. 24, 2012 (JP) ..... 2012-038414

(51) Int. Cl.
*B22F 9/24* (2006.01)
*B22F 1/00* (2006.01)
(Continued)

(52) U.S. Cl.
CPC ..... *B22F 9/24* (2013.01); *B22F 1/0014* (2013.01); *C22C 5/06* (2013.01); *H01B 1/02* (2013.01);
(Continued)

(58) Field of Classification Search
None
See application file for complete search history.

(56) References Cited

U.S. PATENT DOCUMENTS

2008/0138238 A1* 6/2008 Sasaki ..... B22F 1/0018 420/501
2010/0009191 A1* 1/2010 Kuba ..... B22F 1/0044 428/402

FOREIGN PATENT DOCUMENTS

JP A-10-265812 10/1998
JP 10-308118 * 11/1998
(Continued)

OTHER PUBLICATIONS
International Search Report issued in International Application No. PCT/JP2013/054546 dated May 21, 2013.
(Continued)

*Primary Examiner* — Jessee R Roe
*Assistant Examiner* — Ngoclan T Mai
(74) *Attorney, Agent, or Firm* — Oliff PLC

(57) ABSTRACT

The present invention provides a method for producing a silver powder, the method being capable of producing a silver powder with high productivity and at low cost, the silver powder having an average particle diameter of 0.3 to 2.0 μm and a narrow particle size distribution, and provides a silver powder produced by the production method. According to the present invention, the method for producing a silver powder includes: quantitatively and continuously supplying each of a silver solution containing a silver complex and a reductant solution to a flow path; and quantitatively and continuously reducing a silver complex in
(Continued)

a reaction solution obtained by mixing the silver solution with the reductant solution in the flow path, wherein the reaction solution is made to contain a dispersant, and also a silver concentration in the reaction solution is adjusted to be in a range of 5 to 75 g/L.

12 Claims, 2 Drawing Sheets

(51) Int. Cl.
*C22C 5/06* (2006.01)
*H01B 1/02* (2006.01)

(52) U.S. Cl.
CPC ..... *B22F 1/0003* (2013.01); *Y10T 428/12181* (2015.01)

(56) References Cited

FOREIGN PATENT DOCUMENTS

| | | |
|---|---|---|
| JP | A-11-189812 | 7/1999 |
| JP | A-2004-285454 | 10/2004 |
| JP | A-2005-48236 | 2/2005 |
| JP | A-2011-1581 | 1/2011 |

OTHER PUBLICATIONS

Written Opinion of the International Searching Authority issued in International Application No. PCT/JP2013/054546 dated May 21, 2013.

* cited by examiner

SILVER POWDER AND METHOD FOR PRODUCING SAME

FIELD OF THE INVENTION

The present invention relates to a silver powder and a method for producing the same, more specifically, relates to a silver powder serving as a main ingredient of resin-type or baked-type silver pastes to be used for forming a wiring layer, an electrode, and the like of electronic devices, and a method for producing said silver powder.

The present application asserts priority rights based on JP Patent Application 2012-038414 filed in Japan on Feb. 24, 2012. The total contents of disclosure of the Patent Application of the senior filing date are to be incorporated by reference into the present Application.

BACKGROUND OF THE INVENTION

Silver pastes, such as a resin-type silver paste and a baked-type silver paste, have been frequently used for forming a wiring layer, an electrode, and the like of electronic devices. The heat-curing or heat-baking of these silver pastes after applying or printing thereof allow an electrically conductive film of a wiring layer, an electrode, or the like to be formed.

For example, a resin type silver paste comprises a silver powder, a resin, a curing agent, a solvent, and the like, and this resin type silver paste is printed on a conductor circuit pattern or a terminal, and then heat-cured at a temperature of 100 to 200 degrees C. to be made into an electrically conductive film, whereby wiring, an electrode, or the like is formed. On the other hand, a baked type silver paste comprises a silver powder, glass, a solvent, and the like, and this baked type silver paste is printed on a conductor circuit pattern or a terminal, and then heat-baked at a temperature of 600 to 800 degrees C. to be made into an electrically conductive film, whereby wiring, an electrode, or the like is formed. In the wiring or the electrode formed of these silver pastes, there is formed an electric current path having an electrical connection made by silver powders being ranged.

A silver powder used for silver pastes has a particle diameter of approximately 0.1 μm to several μm, and the particle diameter is dependent on the thickness of a wire or an electrode to be formed. Furthermore, a silver powder uniformly dispersing in the paste allows a wire having a uniform thickness or an electrode having a uniform thickness to be formed.

Characteristics required of a silver powder for silver pastes are different, depending on uses and conditions for use, but, general and important characteristics of a silver powder are a uniform particle diameter, less aggregation of particles, and high dispersibility into the paste. This is because a uniform particle diameter and high dispersibility into the paste allows the paste to be uniformly cured or baked, whereby an electrically conductive film having a low resistance and a high strength can be formed. On the contrary, a nonuniform particle diameter and poor dispersibility cause silver particles not to be uniformly present in a printed film, and accordingly leads to not only nonuniformity in thickness of a wire or an electrode but also unevenness of curing or baking, and therefore causes higher resistance of an electrically conductive film or a fragile and weak electrically conductive film to be.

Furthermore, as a characteristic required of a silver powder for silver pastes, it is also important that the silver powder can be manufactured at low cost. This is because the silver powder is a main ingredient of the paste and accordingly accounts for a large share of a paste price. In order to reduce a manufacturing cost, it is important not only high productivity and a low unit price of raw materials or materials to be used, but also low treatment-costs of waste fluid and exhaust gas.

In many cases, the above-mentioned silver powder to be used for silver pastes has been manufactured by a batch method in which a reductant solution is fed into a tank containing an amine complex of a silver salt, such as silver nitrate, thereby being reduced. However, in the batch method, a reduction reaction starts locally at a point where a reductant solution is fed in, and then nuclei of silver particles are formed at all times from the start of feeding the reductant solution to the completion thereof, and therefore it is difficult to obtain a silver powder having a uniform particle diameter.

A proposal to improve particle size distribution is made also for the silver powder production method in which reduction by the batch method is applied. For example, Patent Literature 1 discloses a method for producing a silver powder, wherein a slurry containing an amine complex of a silver salt and an amine complex of a heavy metal salt which functions as a habit modifier at the time of a reduction reaction is mixed with a solution containing potassium sulfite as a reductant and gum arabic as a protective colloid, thereby reducing the amine complex of the silver salt, and collecting formed silver particles.

According to this production method, there can be obtained a particulate silver powder which comprises primary particles having an average particle diameter of 0.1 to 1 μm and has less particle-aggregation and a narrow particle size distribution. However, according to this production method, a silver salt is reduced under the presence of an amine complex of a heavy metal, and accordingly the heavy metal is easily mixed in as an impurity, and therefore there is a possibility that a silver powder obtained has a low purity. Furthermore, Patent Literature 1 does not disclose a specific particle size distribution, and accordingly it is not clear how particle size distribution the silver powder has.

On the other hand, there has been made an another proposal to improve a particle size distribution by applying a continuous method in which a solution containing an amine complex of a silver salt and a reductant solution are continuously mixed and reduced. For example, Patent Literature 2 discloses a method for producing a silver powder, wherein a silver amine complex solution $S_1$ is flown through a certain first flow path a; and an organic reductant and an additive $S_2$ as needed are flown through a second flow path b which is installed so as to join the first flow path a at a midpoint in the first flow path; and then the silver amine complex solution $S_1$, the organic reductant, and the additive $S_2$ come into contact and are mixed at a junction m of the first flow path a and the second flow path b, whereby reduction and precipitation are performed.

However, a silver powder obtained by this method is in the form of minute particles having an average particle diameter $D_{IA}$ of primary particles of not more than 0.6 μm and a crystallite diameter of not more than 10 nm, each being measured by image analysis of a scanning electron microscope image, and therefore is not suitable for the application to common silver pastes, and the use of the silver powder is limited. Furthermore, the silver concentration in a reaction solution is low, and therefore it is hard to say that this production method is excellent in productivity.

Here, including the cases of the above-mentioned prior production methods, silver nitrate has been commonly used as a silver source raw material. However, in a process to dissolve silver nitrate in ammonia water or the like, toxic nitrous acid gas is generated, and accordingly an apparatus to collect the gas is needed. Also, a large amount of nitrate nitrogen and ammonia nitrogen is contained in waste water, and therefore an apparatus to treat these nitrogen is also needed. Furthermore, silver nitrate is a hazardous substance and also a deleterious substance, and therefore needs to be carefully handled. As mentioned above, in the case where silver nitrate is used as a raw material of a silver powder, there is a problem that silver nitrate has a larger impact and risk on environment than other silver compounds do.

Therefore, there has been proposed a method for producing a silver powder by reducing silver chloride without using silver nitrate as a raw material. The advantages of silver chloride are that silver chloride is neither a hazardous substance nor a deleterious substance, and is a silver compound which can be relatively easily handled although it needs to be shielded from light. Furthermore, silver chloride also serves as an intermediate product in a silver refinery process, and there has been offered silver chloride having a purity sufficient for the use in electronics industry.

For example, Patent Literature 3 discloses a method for producing a silver powder, wherein silver chloride is dissolved in ammonia water so as to obtain a solution having a silver concentration of 1 to 100 g/1, and then a reductant is added to this solution and stirred under the presence of a protective colloid, and liquid phase reduction of a silver amine complex contained in the solution is carried out, whereby ultrafine silver particles are obtained. However, since the silver powder obtained by this method has a very small particle diameter, that is, a particle diameter of not more than 0.1 μm, the use thereof in electronics industry has been limited.

As mentioned above, many methods for producing a silver powder have been ever proposed, but, there has never been provided a method which realizes both producing a silver powder having a narrow particle size distribution, namely, having an average particle diameter of 0.1 μm to several μm and a uniform particle diameter, and producing a silver powder with excellent productivity and at low cost.

PRIOR-ART DOCUMENTS

Patent Document

PTL 1: Japanese Patent Application Laid-Open No. H11-189812

PTL 2: Japanese Patent Application Laid-Open No. 2005-48236

PTL 3: Japanese Patent Application Laid-Open No. H10-265812

SUMMARY OF THE INVENTION

The present invention is proposed in view of such conventional circumstances, and aims to provide a method for producing a silver powder, the method being capable of producing a silver powder having an average particle diameter of 0.3 to 2.0 μm and a narrow particle size distribution with high productivity and at low cost, and to provide the silver powder produced by said production method.

In order to achieve the above-mentioned aim, the present inventors have earnestly studied about the particle size control of silver particles obtained in a method for producing a silver powder, wherein a solution containing a silver complex is continuously mixed with a reductant solution to be reduced, and as a result, they have found that the particle size of silver particles to be obtained can be controlled by a silver concentration in a reaction solution, and a higher silver concentration than that in prior arts allows the particle size to be uniform, and thus they have accomplished the present invention.

In other words, a method for producing a silver powder according to the present invention comprises: quantitatively and continuously supplying each of a silver solution containing a silver complex and a reductant solution to a flow path; and mixing said silver solution with said reductant solution in the flow path, thereby quantitatively and continuously reducing a silver complex in a reaction solution, wherein said reaction solution is made to contain a dispersant, and also a silver concentration in said reaction solution is adjusted to be in a range of 5 to 75 g/L.

Here, in the above-mentioned method for producing a silver powder, the adjustment of a silver concentration in the above-mentioned reaction solution allows the particle diameter of silver particles formed by reduction to be controlled.

The above-mentioned silver solution is preferably obtained by dissolving silver chloride in ammonia water.

The above-mentioned reductant is ascorbic acid, and a mixing ratio of a reductant with respect to 1 mol of silver is preferably 0.25 to 0.50 mol at the time of mixing the above-mentioned silver solution and the reductant solution.

Furthermore, as a dispersant, at least one selected from polyvinyl alcohol, polyvinyl pyrrolidone, a denatured silicone oil surface active agent, and a polyether surface active agent is preferably added to the above-mentioned reductant solution.

In the above-mentioned method for producing a silver powder, a silver solution and a reductant solution are preferably mixed at an angle which a supply direction of the reductant solution form with a supply direction of the silver solution in the above-mentioned flow path is not less than 0 degrees and not more than 90 degrees in a plane including the supply directions of both of the solutions. Alternatively, a silver solution and a reductant solution may be mixed at an angle which a supply direction of the reductant solution forms with a supply direction of the silver solution in the above-mentioned flow path is more than 90 degrees and not more than 180 degrees in a plane including the supply directions of both of the solutions.

A reaction solution obtained by mixing a silver solution with a reductant solution in the above-mentioned flow path is preferably homogenized by using a static mixer.

In the above-mentioned production method, the time for the reaction solution obtained by the mixing in the above-mentioned flow path to flow down through said flow path is preferably not less than 15 seconds and not more than 60 seconds. Furthermore, the reaction solution obtained by mixing in the flow path is preferably kept and stirred in a receiving tank arranged at the end of the flow path.

A silver powder according to the present invention is a silver powder obtained by the above-mentioned production method, wherein the average particle diameter of primary particles measured by scanning electron microscope observation is 0.3 to 2.0 μm, and a value obtained by dividing the standard deviation of particle diameter by the average particle diameter is not more than 0.3.

Here, the above-mentioned silver powder preferably has a chlorine content of less than 40 ppm by mass.

Effects of Invention

According to the method for producing a silver powder of the present invention, a silver powder having an average particle diameter which is controlled to be in a range of 0.3 μm to 2.0 μm can be produced by using a method easily feasible for manufacture thereof even at an industrial scale. Furthermore, according to the method for producing a silver powder of the present invention, a high-concentration silver solution is used in the production method to perform continuous reduction, and therefore productivity is very high and furthermore, an inexpensive material, silver chloride, can be used as a starting material, and a nitric acid treatment apparatus for exhaust gas and waste water is not needed, whereby the method can be implemented at low cost.

Furthermore, a silver powder produced by this production method has an appropriate particle diameter as well as a narrow particle size distribution and is suitable for a silver powder for pastes, such as a resin-type silver paste or a baked-type silver paste, to be used for forming a wiring layer, an electrode, and the like of electronic devices, thereby being of great industrial value.

DETAILED DESCRIPTION OF THE INVENTION

Figure 1:
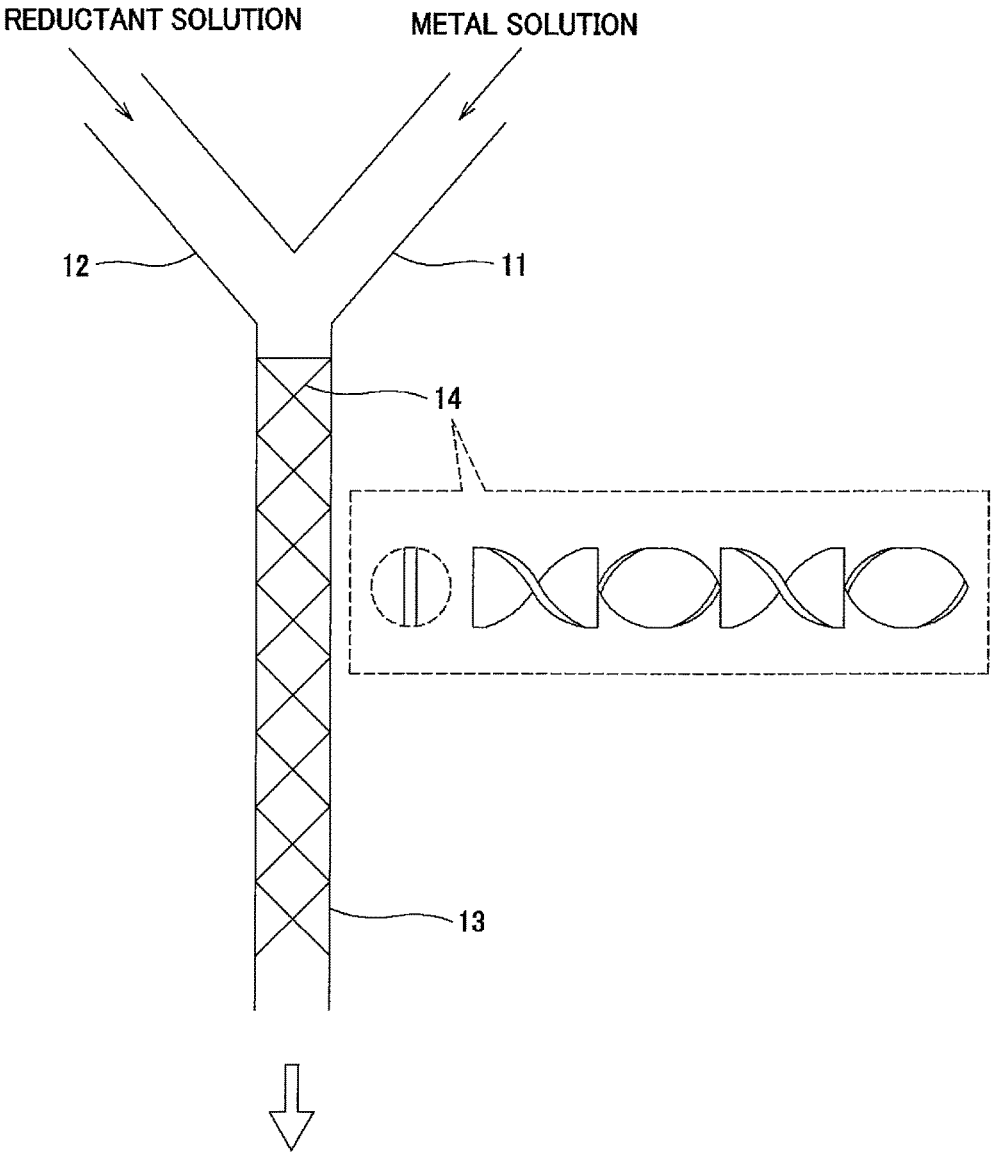
FIG. 1 is a schematic diagram illustrating an example of a reaction pipe for mixing and reacting a silver solution with a reductant solution.

Hereinafter, a method for producing a silver powder according to the present invention and a specific embodiment of a silver powder produced by said production method will be explained in detail. It should be noted that the present invention is not limited to the following embodiment, and various changes may be suitably made within the scope not deviating from the gist of the present invention.

A method for producing a silver powder according to the present embodiment comprises: quantitatively and continuously supplying each of a silver solution containing a silver complex and a reductant solution to a flow path; and quantitatively and continuously reducing a silver complex in a reaction solution obtained by mixing the silver solution with the reductant solution in the flow path, wherein a silver concentration in the reaction solution is adjusted to be in a range of 5 to 75 g/L.

In this method for producing a silver powder, a silver solution and a reductant solution are quantitatively and continuously supplied to a certain space, whereby a reduction reaction is induced in a reaction solution obtained by mixing the silver solution with the reductant solution, and a post-reduction reaction solution obtained after the completion of the reduction reaction, that is, a silver particle slurry is quantitatively and continuously discharged. Thus, the concentration of a silver complex in the space for the reduction reaction and the concentration of a reductant are kept constant, whereby the rate of nucleation and the concentration thereof are made constant, and furthermore a certain particle growth is achieved. According to such method, silver particles obtained are of equal size and thus a silver powder having a narrow particle size distribution can be obtained. Furthermore, the supply of the silver solution and the reductant solution and the discharge of the silver particle slurry are continuously performed, whereby a silver powder can be continuously obtained, and thus a silver powder can be produced with high productivity.

Furthermore, in the method for producing a silver powder according to the present embodiment, it is important to adjust the silver concentration in the reaction solution to a range of 5 to 75 g/L. Such adjustment allows a silver powder having an average particle diameter of 0.3 to 2.0 μm and a narrow particle size distribution to be produced with high productivity. In other words, the method for producing a silver powder according to the present embodiment is such that, by adjusting a silver concentration in the reaction solution to a range of 5 to 75 g/L, the particle diameter and the particle size distribution of silver particles produced by reduction are controlled. As mentioned above, in this production method, the silver solution and the reductant solution are quantitatively continuously mixed, and therefore the concentration of a silver complex and the concentration of a reductant in a reduction reaction space after the mixing are kept constant. Thus, the rate of nucleation and the concentration of nuclei are made constant, and therefore, even with a high silver concentration, abnormal particle growth due to the fluctuation of the concentration is controlled, and the growth rate of particles can be kept constant as a whole, whereby the generation of coarse particles can be controlled.

Here, in the case where the silver concentration is low, the growth rate of particles is kept constant, but the particles do not sufficiently grow, and accordingly minute silver particles are obtained. Such minute silver particles easily causes excessive aggregation between the silver particles in a dry treatment performed after washing. On the other hand, in the case where the silver concentration is high, even if the nucleation concentration is kept constant, too many particles are generated, and therefore aggregation of the particles is caused, whereby coarse particles are formed. Thus, the quantitative and continuous mixing of a silver solution with a reductant solution and the adjustment of a silver concentration in a reaction solution obtained after the mixing to a range of 5 to 75 g/L allow a silver powder having a particle diameter in the above-mentioned range and a narrow particle size distribution to be obtained with high productivity.

More specifically, the particle diameter of silver particles tends to be small when the concentration of a silver complex in a reaction solution is low, meanwhile the particle diameter thereof tends to be large when the concentration of a silver complex in a reaction solution is high, and thus the adjustment of a silver concentration in a reaction solution allows the particle diameter to be controlled. However, a silver concentration of less than 5 g/L leads to a too small particle diameter and insufficient productivity. Furthermore, such silver concentration leads to a low tap density of obtained silver powder. On the other hand, a silver concentration of more than 75 g/L leads to particle aggregation and the resulting formation of coarse particles, thereby causing a wider particle size distribution.

As a reductant to be used in the method for producing a silver powder according to the present embodiment, a common agent, such as hydrazine or formalin, may be used, but ascorbic acid is particularly preferably used. This is because the reducing action of ascorbic acid is mild and accordingly crystalline particles in silver particles easily grow, and furthermore another reason why ascorbic acid is preferable is that ascorbic acid allows particle diameter control to be performed even in a reaction solution having a high silver-concentration. Moreover, in order to control reaction uniformity or reaction rate, there may be used an aqueous solution whose concentration is adjusted by dissolving or diluting a reductant with pure water or the like.

In the case where ascorbic acid is used as a reductant, stoichiometrically, 1 mol of silver can be reduced with 0.25 mol of ascorbic acid. A mixing ratio at the time of mixing a reductant solution with a silver solution is preferably higher than a mixing ratio based on stoichiometry, and specifically, the mixing ratio is preferably 0.25 to 0.50 mol, more preferably 0.30 to 0.40 mol of a reductant with respect to 1 mol of silver. In the case where the mixing ratio is less than 0.25 mol, a silver complex not yet reduced remains in waste fluid, thereby leading to a reduction in silver powder yield. On the other hand, in the case where the mixing ratio is more than 0.50 mol, a large amount of ascorbic acid remains without being used for reduction, thereby leading to a disadvantage in cost.

Furthermore, the inventors have found that, in the case where silver chloride is used as a raw material of a silver powder, the amount of a reductant added with respect to a silver concentration in a reaction solution affects the residual chlorine concentration of a silver powder. A large amount of chlorine derived from a raw material is contained in silver particles obtained by the prior methods in which a silver solution obtained by dissolving silver chloride in ammonia water is reduced with a reductant. However, when the amount of a reductant added is not more than 0.50 mol with respect to 1 mol of silver at a mixing ratio of the reductant solution and the silver solution at the time of mixing thereof, the chlorine concentration of silver powder can be considerably reduced. Thus, even with silver chloride being used as a raw material, a silver powder having a chlorine concentration of less than 40 ppm can be obtained.

It should be noted that only a desired particle diameter of a silver powder and reduction in residual-chlorine-concentration can be achieved by the control of a silver concentration and the addition amount of a reductant to be in the above-mentioned range in silver reduction using a batch method, and furthermore, a silver powder having an excellent particle size distribution can be produced with high productivity by producing a silver powder using the above-mentioned continuous method in which a silver solution and a reductant solution are quantitatively and continuously supplied to a flow path to reduce a silver complex as mentioned above.

The silver solution is a solution containing a silver complex which is to be reduced to silver, and various silver salts can be used as a raw material of silver, but, a silver solution obtained by dissolving silver chloride in ammonia water is preferable. As mentioned above, the use of silver chloride as a raw material can eliminate the necessity of installation of a collecting apparatus for nitrous acid gas and a treatment apparatus for nitrate nitrogen contained in waste water, each apparatus being needed in a method using silver nitrate as a starting material, whereby a process having less impact on environment and a reduction in production cost can be achieved. Furthermore, it was experimentally confirmed that the use of silver chloride makes it possible to more easily achieve both particle diameter control and a higher concentration of silver in a reaction solution than in the case of using other silver salts.

High-purity silver chloride is preferably used, and, as such silver chloride, high-purity silver chloride having a purity of 99.9999% by mass has been stably produced for industrial use. As ammonia water to dissolve silver chloride, common ammonia water for industrial use may be used, but, ammonia water having a purity as high as possible is preferably used in order to prevent impurities from being mixed in.

Hereinafter, with a specific example using silver chloride being mentioned, the method for producing a silver powder according to the present embodiment will be explained in more detail.

It is beneficial that, when a silver solution and a reductant solution each are quantitatively and continuously supplied to a flow path to reduce a silver complex, the concentration and the supply rate of each of the silver solution and the reductant solution are suitably adjusted so as to achieve a reaction solution having a desired silver concentration in a range of 5 to 75 g/L, the reaction solution being obtained by mixing the silver solution with the reductant solution. In the case where the supply rate is too low, a problem arises that the flow rate is decreased, thereby causing silver deposition in a flow path and low productivity. On the other hand, a too high supply rate sometimes causes insufficient mixing of a silver solution with a reductant solution and an insufficient reduction reaction of silver. The supply rate is affected also by the size of a flow path, and therefore, it is beneficial to determine an appropriate supply rate in consideration of the size of a flow path.

At the time of the silver reduction reaction, a reaction solution preferably has a temperature of 25 to 40 degrees C. A reaction solution having a temperature of less than 25 degrees C. causes the low solubility of silver chloride in ammonia water, whereby the silver concentration in the reaction solution cannot be increased, and accordingly a possibility arises that a desired particle diameter cannot be achieved. On the other hand, a reaction solution having a temperature of more than 40 degrees C. causes intense volatilization of ammonia and low solubility, whereby nucleation rate is made higher and a possibility of variation of particle size arises, and furthermore, silver chloride is sometimes precipitated.

In this production method, the silver reduction reaction is preferably completed in a flow path. Accordingly, the flow path is preferably designed to have a flow path length so that the time (flowing-through time) elapsed from the mixing of a silver solution with a reductant solution in the flow path until the mixed solution flows down through the flow path and reaches an outlet is not less than 15 seconds and not more than 60 seconds. In the case where the flowing-through time is less than 15 seconds, sometimes the silver reduction reaction is not completed and a silver complex not yet reduced remains in the reaction solution, whereby particles connect each other to be coarse and aggregation of the particles is caused, thereby leading to low dispersibility. On the other hand, the flowing-through time of more than 60 seconds leads to a wastefully large apparatus. The length of the flow path may be adjusted by connecting a soft tube to a mixing pipe configured to mix a silver solution with a reductant solution and then rolling the tube spirally. Thus, the length of the flow path can be adjusted without requiring a space.

Even when a reduction reaction is completed, activity of an excessive reductant sometimes causes the connection and aggregation of silver particles. Therefore, it is preferable that a receiving tank is arranged at an outlet of the reaction solution, the outlet being positioned at the end of the flow path, and the reaction solution obtained by the mixing and the reduction reaction performed in the flow path is kept and stirred in said receiving tank.

Here, in the receiving tank, the reaction solution needs to be sufficiently stirred to prevent silver particles formed by the reduction from sedimenting. The sedimentation of the silver particles causes the formation of silver particle aggregation and low dispersibility, which are not preferable. It is beneficial to perform the stirring by a force enough to prevent sedimentation of silver particles, and a common stirrer may be used. The reaction solution which flows into the receiving tank is sent to a filter, such as a filter press, with a pump including a deactivated excessive reductant, whereby the reaction solution can be continuously transferred to the following process.

The mixing of a silver solution with a reductant solution is performed while an angle which a supply direction of the reductant solution forms with a supply direction of the silver solution in a flow path is not less than 0 degrees and not more than 90 degrees in a plane including the supply directions of both of the solutions. When a supply direction of the reductant solution forms an angle of not less than 0 degrees and not more than 90 degrees with a supply direction of the silver solution, a backflow of the reductant solution to a silver solution supply pipe for supplying the silver solution, or a backflow of the silver solution to a reductant supply pipe for supplying the reductant solution can be prevented, whereby a silver powder can be prevented from sedimenting in the vicinity of an outlet of any of the supply pipes. It should be noted that, in the case where such silver powder sediment is formed, sometimes the silver powder sediment exfoliates and is mixed into a silver powder as coarse particles, and furthermore, if the sedimentation proceeds, any of the supply pipes may be blockaded.

An apparatus used for the mixing of the silver solution with the reductant solution, that is, a reaction pipe is not particularly limited, and there is used a reaction pipe comprising a silver solution supply pipe configured to supply a silver solution; a reductant solution supply pipe configured to supply a reductant solution; and a two-solution mixing pipe configured to mix the silver solution with the reductant, and having a structure configured to mix the silver solution with the reductant solution in the mixing pipe, and examples of the reaction pipe include a Y-shaped pipe. It should be noted that, as mentioned later, terms mentioned here, namely, the "reaction pipe" and the "mixing pipe" do not represent and are not limited to only what is blockaded thereby to form a hollow, such as an outer perimeter of a tube or a pipe, but examples of the pipe include what has a shape which is partially opened of the outer perimeter, such as a gutter, and the terms represent what has a site which allows a supplied silver solution and a supplied reductant solution to be mixed and react each other in any of pipe shapes.

More specifically, FIG. 1 illustrates a schematic diagram of a Y-shaped pipe (Y-shaped reaction pipe) 10 as an specific example of the reaction pipe. As shown in FIG. 1, the Y-shaped pipe 10 comprises a silver solution supply pipe 11 configured to supply a silver solution containing a silver complex; a reductant solution supply pipe 12 configured to supply a reductant solution; and a mixing pipe 13 configured to mix the silver solution with the reductant.

With the use of such Y-shaped pipe 10, a silver solution and a reductant solution can be quantitatively and continuously supplied and mixed in the mixing pipe 13 thereby to prepare a reaction solution, whereby a silver complex can be quantitatively and continuously reduced.

The diameter of each pipe of the reaction pipe may be determined based on the supplying amount of each of the solutions so as not to cause an excessive resistance against the supply of the silver solution and the reductant solution and also so as to perform sufficient stirring.

Furthermore, each pipe of the reaction pipe is in the form of pipe, and the shape is not particularly limited, but a cylindrical pipe is preferable because such pipe is easily connected with the supply piping for supplying a silver solution and a reductant solution. Furthermore, it is important to select a material of the reaction pipe, the material not reacting a silver solution and a reductant solution and not causing silver after a reduction reaction to adhere thereto, and as long as a material satisfies the above-mentioned conditions, the material is beneficial. Examples of the material include glass, vinyl chloride, polypropylene, polyethylene, and Teflon (registered trademark), and among these, glass is more preferably used.

Furthermore, to supply a silver solution and a reductant solution through the silver solution supply pipe 11 and the reductant solution supply pipe 12, respectively, a common metering pump may be used. Here, a metering pump accompanying small pulsation is preferably used. Furthermore, for example, in the case where the supply amount of a reductant solution is smaller than the supply amount of a silver solution, the reductant solution is supplied at a higher flow rate so that these two solutions are fully mixed at the junction of the solutions.

Furthermore, as shown in FIG. 1 (and a partially enlarged view in FIG. 1), a static mixer (SM) 14 can be installed in the mixing pipe 13 constituting the Y-shaped pipe 10. When a silver solution and a reductant solution each are supplied, the solutions are mixed by turbulent flow, diffusion, and the like, in the mixing pipe 13, whereby a reaction solution is formed. Here, in the case where the solutions are not uniformly mixed or it takes time to complete the mixing, the static mixer 14 is installed at the downstream side of the junction of the silver solution and the reductant solution, whereby the reaction solution can be made uniform.

As the static mixer 14, there are a collision plate type static mixer, a twisted wing type static mixer, and the like, but, a twisted wing type static mixer is preferable because the static mixer 14 is installed in the mixing pipe 13. Furthermore, as shown in a partially enlarged view in FIG. 1, a twisted wing type static mixer is configured such that, when a twisted wing (fixed screw) twisted at an angle of 90 degrees is regarded as one element, a few elements of twisted wings each having a different twist direction are alternately arranged. The partially enlarged view in FIG. 1 illustrates that rightward-twisted elements and leftward-twisted elements are alternately arranged in the order from left to right.

The number of elements of the static mixer 14 is not particularly limited, but, a too small number of the elements sometimes causes insufficient mixing of a silver solution with a reductant solution and the resulting nonuniform reduction reaction, thereby causing formation of minute particles. On the other hand, a too large number of the elements sometimes causes not only a wastefully-long mixing pipe, but also adhesion of silver to the pipe. The number of the elements is suitably determined by the supply amount and the flow rate of each of the solutions so as to achieve a sufficient mixing of the solutions. From viewpoints of silver adhesion and reactivity, the material is preferably glass.

An angle which the mixing pipe 13 forms with a horizontal plane may be determined arbitrarily, but, in the case where a large void is formed between the inside of the mixing pipe 13 and a reaction solution, for example, in the case where a void accounts for not less than 80% of a cross section of the mixing pipe or in the case where a gutter-shaped mixing pipe mentioned later is used, the mixing pipe preferably forms an angle of 20 degrees to 40 degrees with a horizontal plane. Thus, the flow rate of the reaction solution in the mixing pipe can be appropriately controlled, whereby a sufficient reaction time can be secured.

The above-mentioned Y-shaped pipe 10 is only one example of the reaction pipe to be used, and of course, the reaction pipe is not limited to it. For example, the mixing pipe to be used is not necessarily pipe-shaped, and may be gutter-shaped, that is, may have an opening portion at the upper part thereof. Furthermore, the cross section of the gutter-shaped mixing pipe may have a shape obtained by cutting off a part of a circle, an ellipse, a polygon, or the like, and particularly, a circular cross section is preferable as the shape of the cross section thereof.

In the case where such gutter-shaped mixing pipe is used, a silver solution supply pipe and a reductant supply pipe each are connected to the mixing pipe so that the supply direction of a silver solution and the supply direction of a reductant solution intersect each other. For example, a silver solution supply pipe is connected so that a silver solution is flown from the upper end of the mixing pipe in parallel with the mixing pipe, meanwhile a reductant supply pipe is connected on a downstream side at a distance of a few centimeters from the upper end of the mixing pipe so that a reductant solution is flown into the mixing pipe from a direction perpendicular to the mixing pipe. Thus, each of the solutions supplied from the corresponding one of the supply pipes is made to collide each other at the intersection point in the mixing pipe and thereby mixed, whereby sufficient mixing can be performed. It is more preferable that the inside diameter of a mixing pipe is the extent to which a space remains in the upper part of the mixing pipe when viewed from a cross section perpendicular to a flow, than that the inside diameter thereof is small to the extent that a resistance against the flows of a silver solution and a reductant solution is high.

As mentioned above, when a silver solution is mixed with a reductant solution, the mixing thereof is preferably performed so that an angle which a supply direction of the reductant solution forms with a supply direction of the silver solution is not less than 0 degrees and not more than 90 degrees in a plane including the supply directions of both of the solutions, whereby a backflow of the reductant solution to a silver solution supply pipe and a backflow of the silver solution to a reductant supply pipe can be prevented and a silver powder can be prevented from sedimenting in the vicinity of an outlet of any of the supply pipes. However, in the case where the supply direction of the reductant solution forms an angle of not more than 15 degrees with the supply direction of the silver solution, only with the flow of each of the solutions, sometimes the mixing of the reductant solution with the silver solution is not sufficiently performed.

Therefore, in the case where the supply direction of the reductant solution forms an angle of not more than 15 degrees with the supply direction of the silver solution, inside any one of the supply pipes, an outlet of another supply pipe is preferably arranged. In other words, it is preferable that the supply direction of a reductant solution forms an angle of 0 degrees with the supply direction of a silver solution in a plane including the supply directions of both of the solutions, and the two solutions, namely, the silver solution and the reductant solution are flown in the same direction.

A specific aspect is such that, at the center of any one of supply pipes, an outlet of another supply pipe is arranged, whereby a silver solution and a reductant solution are flown in the same direction. Usually, the flow rate of the silver solution is higher than that of the reductant solution, and accordingly the silver solution supply pipe has a larger diameter than the reductant supply pipe has. Therefore, an outlet of a reductant supply pipe is preferably arranged inside a silver solution supply pipe, and piping configured to supply a reductant solution is preferably arranged inside and on the same axis as piping configured to supply a silver solution. Thus, the solutions are sufficiently mixed each other, and also a reduction reaction is caused in the vicinity of the center of a reaction pipe meanwhile a reduction reactions is less caused in the vicinity of an inner wall of the reaction pipe, whereby adhesion of silver to the inner wall of the reaction pipe is less caused, and formation of coarse particles can be controlled.

Figure 2:
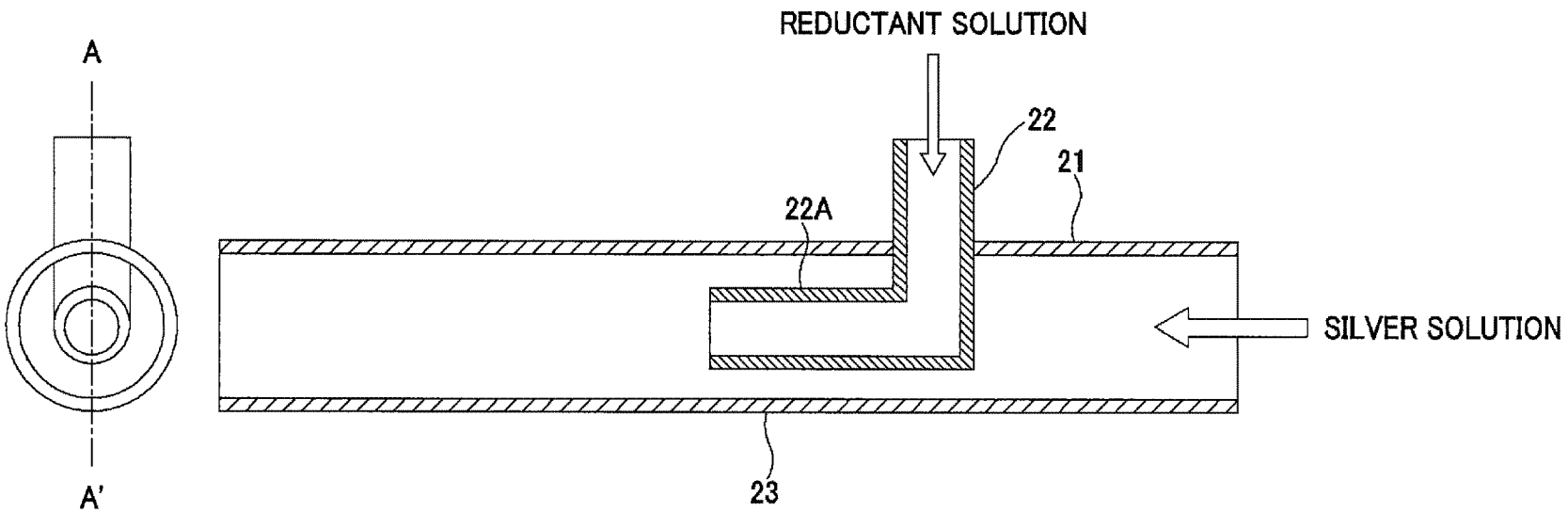
FIG. 2 is a sectional schematic diagram illustrating an example of a reaction pipe in which an outlet of a reductant solution supply pipe is arranged inside a silver solution supply pipe.

Here, FIG. 2 shows one example of a reaction pipe 20 which is configured such that an outlet of the reductant solution supply pipe configured to supply a reductant solution is arranged inside the silver solution supply pipe configured to supply a silver solution. FIG. 2 is a schematic diagram illustrating a cross section AA' of the reaction pipe. As shown in FIG. 2, the reaction pipe 20 comprises a silver solution supply pipe 21 configured to feed a silver solution containing a silver complex; a reductant solution supply pipe 22 configured to supply a reductant solution; and a mixing pipe 23 in which the silver solution supply pipe 21 is connected to the reductant solution supply pipe 22 and which is configured to mix the silver solution with the reductant. It should be noted that, also in the reaction pipe 20, a static mixer may be installed at the downstream side of the junction of the silver solution and the reductant solution in the mixing pipe 23.

As shown in FIG. 2, in the reaction pipe 20, an outlet of the reductant solution supply pipe 22 is arranged inside the silver solution supply pipe 21 so that the supply direction of a reductant solution forms an angle of 0 degree with the supply direction of a silver solution, in other words, both of the solutions are supplied in the same direction. Thus, the sedimentation of reduced silver in the vicinity of the outlet of the reductant supply pipe 22 can be controlled. Furthermore, in the reaction pipe 20, the outlet of the reductant solution supply pipe 22 is positioned at the center of the silver solution supply pipe 21 so as to easily mix a silver solution with a reductant solution.

The diameter and the length of each of the silver solution supply pipe 21 and the reductant solution supply pipe 22 are not particularly limited, and preferably suitably determined so that the mixing can be effectively performed by a difference in flow rate between a silver solution and a reductant solution, each being supplied through the corresponding one of the supply pipes.

For example, in the reaction pipe 20, a linear portion 22A of the reductant solution supply pipe 22 is installed inside the silver solution supply pipe 21, the linear portion 22A being arranged on the same axis as the silver solution supply pipe 21 and having a length not less than 5 times as long as the inside diameter of the reductant solution supply pipe 22. Thus, the reductant solution which flows out of the outlet of the reductant solution supply pipe 22 can be made into a laminar flow, and both of the solutions can be uniformly mixed by the difference in flow rate between the solutions.

It should be noted that the arrangement of each of the supply pipes may be suitably changed based on the supply amount or the flow rate of each of the solutions. Moreover, the size of each of the supply pipes is also not particularly limited, but may be suitably determined based on the desired flow rate or the desired flow condition for supplying each of the solutions.

In the case where when a silver solution needs to be more promptly mixed with a reductant solution, the mixing may be performed, with the supply direction of the reductant solution forming an angle of more than 90 degrees and not more than 180 degrees, preferably not less than 135 degrees and not more than 180 degrees with the supply direction of a silver solution in a plane including the supply directions of both of the solutions. Specifically, for example, in an aspect in which the supply direction of the reductant solution forms an angle of 180 degrees with the supply direction of a silver solution in a plane including the supply directions of both of the solutions, a reductant solution supply pipe configured to supply the reductant solution is arranged inside and on the same axis as a silver solution supply pipe configured to supply the silver solution. Furthermore, via each of the pipes arranged on the same axis, the silver solution and the reductant solution are made to flow in the opposite direction to each other, in other words, said solutions are made to flow so that the flows face each other, thereby being mixed.

Thus, the mixing of a silver solution with a reductant solution is perfotmed with the supply directions of both of the solutions forming an angle of more than 90 degrees and not more than 180 degrees, preferably not less than 135 degrees and not more than 180 degrees in a plane including the supply directions of both of the solutions, whereby a turbulent flow is easily caused when both of the solutions meet, and accordingly prompt mixing can be achieved. However, in this case, there is a possibility of silver sedimentation in the supply pipe, and therefore the supply amount and the flow rate of each of the solutions need to be adjusted. In order to control silver sedimentation in the supply pipe, it is effective to make the flow rate of the solutions higher. It is beneficial that configurations and conditions are the same as in the case in which an angle formed with the supply directions is not more than 90 degrees, except an angle formed with the supply directions.

In the method for producing a silver powder according to the present embodiment, it is important that a reaction solution obtained by mixing a silver solution with a reductant solution is made to contain a dispersant. In the case where a dispersant is not contained therein, silver particles formed by reduction aggregate, thereby forming coarse particles or causing low dispersibility. As a dispersant, at least one selected from polyvinyl alcohol, polyvinyl pyrrolidone, a denatured silicone oil surface active agent, and a polyether surface active agent is preferable, or more preferably, not less than two of these are used in combination.

It is preferable that a dispersant is added to a reductant solution in advance, and then made to be contained in a reaction solution. As an option, a dispersant may be mixed with a silver solution in advance, but, it was experimentally confirmed that the mixing of a dispersant with a reductant solution in advance allows a silver powder having higher dispersibility to be obtained. This is considered because the addition of a dispersant to a reductant solution in advance allows the dispersant to be present in a formation site of silver particles, whereby aggregation of silver particles can be efficiently controlled. It should be noted that polyvinyl alcohol and polyvinyl pyrrolidone, which are used as a dispersant, sometimes foam at the time of a reduction reaction, and therefore a defoaming agent may be added to a reductant solution and a silver solution.

The content of a dispersant may be suitably determined based on a type of the dispersant or a silver particle diameter to be obtained, but preferably 3 to 20% by mass with respect to silver contained in a silver solution. In the case where the content of a dispersant is less than 3% by mass, there is a possibility that an effect of controlling the aggregation of silver particles may not be sufficiently achieved, on the other hand, also in the case where the content of a dispersant is more than 20% by mass, the effect of controlling the particle aggregation is not further improved, and loads, such as waste water treatment, are only increased.

An obtained silver slurry is filtered, and then washed and dried. A washing method is not particularly limited, and, for example, there is employed a method wherein silver particles are fed into water, and stirred using a stirrer or an ultrasonic washing apparatus, and then filtered to collect a silver powder. In this method, an operation comprising the feeding of silver particles into water, stirring-washing, and filtration is preferably repeated a few times. Furthermore, as the water used for washing, water not containing an impurity element harmful to a silver powder is used, and particularly, pure water is preferably used.

Then, after water-washed, silver particles are dried by evaporating moisture. An example of a drying method is such that silver particles after water-washed are placed on a stainless steel pad and heated at a temperature of approximately 40 to 80 degrees C., using a common drying apparatus, such as an air oven or a vacuum dryer.

A silver powder produced by the production method mentioned above in detail has an average particle diameter measured by scanning electron microscope observation, that is, an average particle diameter of primary particles (silver particles) of 03 to 2.0 μm, and a value obtained by dividing the standard deviation of particle diameter by the average particle diameter is not more than 0.3. Furthermore, the silver powder has a tap density of 4 to 6 g/cm$^3$. Here, the primary particle represents a particle regarded as a unit particle by judging from its appearance. Furthermore, the average particle diameter represents a number-average particle diameter, and an average particle diameter and standard deviation are obtained based on the results of particle diameter measurement of not less than 300 primary particles, using SEM observation.

Such silver powder has a narrow particle size distribution and high dispersibility. Since the silver powder thus has good dispersibility, the silver powder is suitably used as a silver powder for pastes, such as a resin-type silver paste or a baked-type silver paste, the pastes being used for forming a wiring layer or an electrode of electronic devices.

Furthermore, optimizing the above-mentioned production conditions allows this silver powder to have a chlorine content of less than 40 ppm by mass. A high content of chlorine causes not only an increase in electric resistance of a formed wiring layer or a formed electrode, but also migration between wirings. Therefore, also from these viewpoints, a silver powder having a reduced content of chlorine is suitable as a silver powder for pastes to be used for electronic devices.

EXAMPLES

Hereinafter, specific Examples according to the present invention will be explained. However, the present invention is not limited to the following Examples at all.

Example 1

In a tub heated by a hot-water jacket having a temperature of 38 degrees C., 1940 g of silver chloride (manufactured by Sumitomo Metal Mining Co., Ltd., 99.9999% purity, 10.55% moisture content) was fed into 36 L of 25%-by-mass ammonia water maintained at a liquid temperature of 36 degrees C. while being stirred, whereby a silver solution was prepared. A defoaming agent (ADEKANOL LG-126, manufactured by ADEKA Corp.) was diluted 100 times at a volume ratio, and 17 ml of this diluted solution of defoaming agent was added to the prepared silver solution, then the obtained silver solution was maintained at 36 degrees C. in a hot bath.

Next, 968 g of ascorbic acid (reagent, manufactured by KANTO CHEMICAL Co., Inc.) as a reductant was dissolved in 5.35 L of pure water having a temperature of 30 degrees C. Furthermore, 293 g of polyvinyl alcohol (PVA205, manufactured by KURARAY Co., Ltd.) as a dispersant was dissolved in 10 L of pure water having a temperature of 50 degrees C. These two solutions were mixed to prepare a reductant solution, and said reductant solution was adjusted to have a temperature of 36 degrees C.

By using a smoothflow pump (APL-5, BPL-2, manufactured by TACMINA CORPORATION), the silver solution and the reductant solution were supplied to a reaction pipe at 2.4 L/minute and 0.8 L/minute, respectively, and, while being stirred, the reaction solution discharged from the reaction pipe was kept in a receiving tank. As the reaction pipe, a Y-shaped pipe having an inside diameter of 10 mm was used, and an angle which a pipe to supply the silver solution formed with a pipe to supply the reductant solution was made to be 60 degrees. Furthermore, in the reaction pipe, a static mixer was arranged downstream from the junction of the silver solution and the reductant solution. In the static mixer, eight rightward-twisted and leftward-twisted elements in total were alternately arranged. In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point in time, the reduction rate was 78 g/minute in the amount of silver, and the silver concentration in the reaction solution was 24.5 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 18 L of a 0.01 mol/L NaOH solution and stirred for 15 minutes, and then filtered and collected, by using a filter press. An operation comprising the feeding into the NaOH solution, the stirring, and the filtration was further repeated twice, and then the collected silver particles were fed into 18 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.79 μm, the diameter being measured by scanning electron microscope; a value obtained by dividing the standard deviation (σ) of particle diameter by the average particle diameter (Ave.) was 0.15; and the silver powder had high dispersibility, hence the silver powder was good as a silver powder for pastes. Furthermore, the concentration of chlorine contained in the silver powder was analyzed in such a manner that the obtained silver powder was decomposed by nitric acid, and the resulting silver chloride was filtered and separated, then reduced, and the resulting free chloride ions were analyzed by an ion chromatograph (ICS-1000, manufactured by Dionex Corporation). As a result, the chlorine concentration was 22 ppm.

Example 2

In a tub heated by a hot-water jacket having a temperature of 38 degrees C., 2705 g of silver chloride (manufactured by Sumitomo Metal Mining Co., Ltd., 99.9999% purity, 10.55% moisture content) was fed into 36 L of 25%-by-mass ammonia water maintained at a liquid temperature of 36 degrees C. while being stirred, whereby a silver solution was prepared. A defoaming agent (ADEKANOL LG-126, manufactured by ADEKA Corp.) was diluted 100 times at a volume ratio, and 24 ml of this diluted solution of defoaming agent was added to the prepared silver solution, then the obtained silver solution was maintained at 36 degrees C. in a hot bath.

Next, 1279 g of ascorbic acid (reagent, manufactured by KANTO CHEMICAL Co., Inc.) as a reductant was dissolved in 4.55 L of pure water having a temperature of 30 degrees C. Furthermore, 387 g of polyvinyl alcohol (PVA205, manufactured by KURARAY Co., Ltd.) as a dispersant was dissolved in 10 L of pure water having a temperature of 50 degrees C. These two solutions were mixed to prepare a reductant solution, and said reductant solution was adjusted to have a temperature of 36 degrees C.

By using a smoothflow pump (APL-5, BPL-2, manufactured by TACMINA CORPORATION), the silver solution and the reductant solution were fed into a reaction pipe at 2.4 L/minute and 0.8 L/minute, respectively, and, while being stirred, the reaction solution discharged from the reaction pipe was kept in a receiving tank. As the reaction pipe, a Y-shaped pipe having an inside diameter of 10 mm was used, and an angle which a pipe to supply the silver solution formed with a pipe to supply the reductant solution was made to be 60 degrees. Furthermore, in the reaction pipe, a static mixer was arranged downstream from the junction of the silver solution and the reductant solution. In the static mixer, eight rightward-twisted and leftward-twisted elements in total were alternately arranged. In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point, the reduction rate was 109 g/minute in the amount of silver, and the silver concentration in the reaction solution was 34.0 g/L. Furthermore, the mixing ratio of ascorbic acid with respect to 1 mol of silver, the ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 26 L of a 0.01 mol/L NaOH solution and stirred for 15 minutes, and then filtered and collected, by using a filter press. An operation comprising the feeding into the NaOH solution, the stirring, and the filtration was further repeated twice, and then the collected silver particles were fed into 26 L of pure water, and an operation comprising stirring and filtration was performed.

After the filtration, the silver particles were moved to a stainless steel pad, and, using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 1.01 μm, the diameter being measured by SEM observation; a value obtained by dividing the standard deviation of particle diameter by the average particle diameter was 0.16; and the silver powder had high dispersibility, hence the silver powder was good as a silver powder for pastes. Furthermore, the concentration of chlorine contained in the silver powder was analyzed in the same manner as in Example 1, and a result, the chlorine concentration was 19 ppm.

Example 3

In a hot bath at a temperature of 38 degrees C., while being stirred, 81 g of silver chloride (manufactured by Sumitomo Metal Mining Co., Ltd., 99.9999% purity, 10.55% moisture content) was fed into 7.35 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 0.7 ml of this diluted solution of defoaming agent was added to the prepared silver solution, then the obtained silver solution was maintained at 36 degrees C. in a hot bath.

Next, 35 g of ascorbic acid (reagent, manufactured by KANTO CHEMICAL Co., Inc.) as a reductant was dissolved in 1.0 L of pure water having a temperature of 30 degrees C. Furthermore, 11 g of polyvinyl alcohol (PVA205, manufactured by KURARAY Co., Ltd.) as a dispersant was dissolved in 1.71 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 0 degrees with a supply direction of the silver solution. In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point, the reduction rate was 18 g/minute in the amount of silver, and the silver concentration in the reaction solution was 5.0 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a membrane filter having an opening diameter of 0.1 μm, whereby silver particles were solid-liquid separated. Subsequently, the collected silver particles were fed into 0.8 L of a 0.01 mol/L NaOH solution and stirred for 15 minutes, and then filtered and collected, by using a membrane filter having an opening diameter of 0.1 μm. An operation comprising the feeding into the NaOH solution, the stirring, and the filtration was further repeated twice, and then the collected silver particles were fed into 0.8 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.39 μm, the diameter being measured by SEM observation; a value obtained by dividing the standard deviation of particle diameter by the average particle diameter was 0.20; and the silver powder had high dispersibility, hence the silver powder was good as a silver powder for pastes. Furthermore, the concentration of chlorine contained in the silver powder was analyzed in the same manner as in Example 1, and a result, the chlorine concentration was 23 ppm.

Example 4

In a hot bath at a temperature of 38 degrees C., while being stirred, 128 g of silver chloride (manufactured by Sumitomo Metal Mining Co., Ltd., 99.9999% purity, 10.55% moisture content) was fed into 4.91 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 1.1 ml of this diluted solution of defoaming agent was added to the prepared silver solution, then the obtained silver solution was maintained at 36 degrees C. in a hot bath.

Next, 58 g of ascorbic acid (reagent, manufactured by KANTO CHEMICAL Co., Inc.) as a reductant was dissolved in 0.6 L of pure water having a temperature of 30 degrees C. Furthermore, 46 g of polyvinyl alcohol (PVA205, manufactured by KURARAY Co., Ltd.) as a dispersant was dissolved in 1.31 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 0 degrees with a supply direction of the silver solution.

In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point in time, the reduction rate was 42 g/minute in the amount of silver, and the silver concentration in the reaction solution was 11.8 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a membrane filter having an opening diameter of 0.1 μm, whereby silver particles were solid-liquid separated. Subsequently, the collected silver particles were fed into 1.2 L of a 0.01 mol/L NaOH solution and stirred for 15 minutes, and then filtered and collected, by using a membrane filter having an opening diameter of 0.1 μm. An operation comprising the feeding into the NaOH solution, the stirring, and the filtration was further repeated twice, and then the collected silver particles were fed into 1.2 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.54 μm, the diameter being measured by SEM observation; a value obtained by dividing the standard deviation of particle diameter by the average particle diameter was 0.21; and the silver powder had high dispersibility, hence the silver powder was good as a silver powder for pastes. Furthermore, the concentration of chlorine contained in the silver powder was analyzed in the same manner as in Example 1, and a result, the chlorine concentration was 35 ppm.

Example 5

In a hot bath at a temperature of 38 degrees C., while being stirred, 5249 g of silver chloride (manufactured by Sumitomo Metal Mining Co., Ltd., 99.9999% purity, 10.55% moisture content) was fed into 90 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 46 ml of this diluted solution of defoaming agent was added to the prepared silver solution, then the obtained silver solution was maintained at 36 degrees C. in a hot bath.

Next, 2199 g of ascorbic acid (reagent, manufactured by KANTO CHEMICAL Co., Inc.) as a reductant was dissolved in 10 L of pure water having a temperature of 30 degrees C. Furthermore, 665 g of polyvinyl alcohol (PVA205, manufactured by KURARAY Co., Ltd.) as a dispersant was dissolved in 22.23 L of pure water having a temperature of 36 degrees C. These two solutions were mixed to prepare a reductant solution, and said reductant solution was adjusted to have a temperature of 36 degrees C.

By using a smoothflow pump (APL-5, BPL-2, manufactured by TACMINA CORPORATION), the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 0 degrees with a supply direction of the silver solution. In order to completely tenainate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point, the reduction rate was 95 g/minute in the amount of silver, and the silver concentration in the reaction solution was 26.5 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 49 L of a 0.01 mol/L NaOH solution and stirred for 15 minutes, and then filtered and collected, by using A filter press. An operation comprising the feeding into the NaOH solution, the stirring, and the filtration was further repeated twice, and then the collected silver particles were fed into 49 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.91 μm, the diameter being measured by SEM observation; a value obtained by dividing the standard deviation of particle diameter by the average particle diameter was 0.15; and the silver powder had high dispersibility, hence the silver powder was good as a silver powder for paste. Furthermore, the concentration of chlorine contained in the silver powder was analyzed in the same manner as in Example 1, and a result, the chlorine concentration was 20 ppm.

Example 6

In a hot bath at a temperature of 38 degrees C., while being stirred, 434 g of silver chloride (manufactured by Sumitomo Metal Mining Co., Ltd., 99.9999% purity, 10.55% moisture content) was fed into 4.91 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 3.8 ml of this diluted solution of defoaming agent was added to the prepared silver solution, then the obtained silver solution was maintained at 36 degrees C. in a hot bath.

Next, 197 g of ascorbic acid (reagent, manufactured by KANTO CHEMICAL Co., Inc.) as a reductant was dissolved in 0.6 L of pure water having a temperature of 30 degrees C. Furthermore, 12.1 g of polyvinyl alcohol (PVA205, manufactured by KURARAY Co., Ltd.) as a dispersant was dissolved in 1.31 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 0 degrees with a supply direction of the silver solution. In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point, the reduction rate was 144 g/minute in the amount of silver, and the silver concentration in the reaction solution was 40.1 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a membrane filter having an opening diameter of 0.3 μm, whereby silver particles were solid-liquid separated. Subsequently, the collected silver particles were fed into 4.1 L of a 0.01 mol/L NaOH solution and stirred for 15 minutes, and then filtered and collected, by using a membrane filter having an opening diameter of 0.3 μm. An operation comprising the feeding into the NaOH solution, the stirring, and the filtration was further repeated twice, and then the collected silver particles were fed into 4.1 L of pure water, and an operation comprising stirring and filtration was performed. After the filtration, the silver particles were moved to a stainless steel pad, and, using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 1.18 μm, the diameter being measured by SEM observation; a value obtained by dividing the standard deviation of particle diameter by the average particle diameter was 0.23; and hence the silver powder was good as a silver powder for pastes.

Example 7

In a hot bath at a temperature of 38 degrees C., while being stirred, 178 g of silver chloride (manufactured by Sumitomo Metal Mining Co., Ltd., 99.9999% purity, 12.5% moisture content) was fed into 1.11 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 1.5 ml of this diluted solution of defoaming agent was added to the prepared silver solution, then the obtained silver solution was maintained at 36 degrees C. in a hot bath.

Next, 74 g of ascorbic acid (reagent, manufactured by KANTO CHEMICAL Co., Inc.) as a reductant was dissolved in 0.3 L of pure water having a temperature of 30 degrees C. Furthermore, 8 g of polyvinyl alcohol (PVA205, manufactured by KURARAY Co., Ltd.) as a dispersant was dissolved in 0.15 L of pure water having a temperature of 50 degrees C. These two solutions were mixed to prepare a reductant solution, and said reductant solution was adjusted to have a temperature of 36 degrees C.

By using a Mohno pump (3NB-06, 3NB-04, manufactured by HEISHIN Ltd.), the silver solution and the reductant solution were supplied to a reaction pipe at 0.24 L/minute and 0.08 L/minute, respectively, and, while being stirred, the reaction solution discharged from the reaction pipe was kept in a receiving tank. As the reaction pipe, there was used a polyethylene pipe having an inside diameter of 13 mm and a length of 500 mm, the polyethylene pipe being fixed with an inclination of approximately 16 degrees. The silver solution was made to flow from the upper end of the pipe, meanwhile the reducing solution was made to flow from a point 30 mm downstream from the upper end. An angle which a supply direction of the reductant solution formed with a supply direction of the silver solution was made to be 90 degrees. In order to completely terminate a reduction reaction during solution transfer, a soft polyvinylchloride resin tube having an insider diameter of 13 mm and a length of 1 m was connected to the outlet side of the reaction pipe, whereby the reaction solution was transferred to the receiving tank. At this point, the reduction rate was 23 g/minute in the amount of silver, and the silver concentration in the reaction solution was 71.0 g/L. Furthermore, the mixing ratio of ascorbic acid with respect to 1 mol of silver, the mixing ratio being obtained based on the supply rate, was 0.30 mol. The polyvinyl alcohol content of the dispersant was 5% by mass with respect to the amount of silver in the reaction solution at the time of mixing. Moreover, after the supply of the silver solution and the reductant solution was completed, stirring in the receiving tank was continued for 30 minutes.

The silver solution obtained after the completion of the stirring was filtered by using a membrane filter having an opening diameter of 0.1 ptn, whereby silver particles were solid-liquid separated. Subsequently, the collected silver particles were fed into 1.8 L of a 0.01 mol/L NaOH solution and stirred for 15 minutes, and then filtered and collected, by using a membrane filter having an opening diameter of 0.1 μm. An operation comprising the feeding into the NaOH solution, the stirring, and the filtration was further repeated twice, and then the collected silver particles were fed into 1.8 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.73 μm, the diameter being measured by SEM observation; a value obtained by dividing the standard deviation of particle diameter by the average particle diameter was 0.29; and hence the silver powder was good as a silver powder for pastes.

Example 8

In a hot bath at a temperature of 38 degrees C., while being stirred, 292 g of silver chloride (manufactured by Sumitomo Metal Mining Co., Ltd., 99.9999% purity, 7.9% moisture content) was fed into 1.92 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 2.6 ml of this diluted solution of defoaming agent was added to the prepared silver solution, then the obtained silver solution was maintained at 36 degrees C. in a hot bath.

Next, 126 g of ascorbic acid (reagent, manufactured by KANTO CHEMICAL Co., Inc.) as a reductant was dissolved in 1.02 L of pure water having a temperature of 30 degrees C. Furthermore, 14 g of polyvinyl alcohol (PVA205, manufactured by KURARAY Co., Ltd.) as a dispersant was dissolved in 0.51 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.1 L/minute and 0.7 L/minute, respectively, and, while being stirred, the reaction solution discharged from the reaction pipe was kept in a receiving tank. As the reaction pipe, there was used a hard polyvinylchloride resin pipe having an inside diameter of 25 mm and a length of 725 mm, the pipe being fixed with an inclination of approximately 16 degrees. The silver solution was made to flow from the upper end of the pipe, meanwhile the reducing solution was made to flow from a point 30 mm downstream from the upper end. An angle which a supply direction of the reductant solution formed with a supply direction of the silver solution was made to be 90 degrees. In order to completely terminate a reduction reaction during solution transfer, a soft polyvinylchloride resin tube having an insider diameter of 25 mm and a length of 1 m was connected to the outlet side of the reaction pipe, whereby the reaction solution was transferred to the receiving tank. At this point, the reduction rate was 100 g/minute in the amount of silver, and the silver concentration in the reaction solution was 35.5 g/L. Furthermore, the mixing ratio of ascorbic acid with respect to 1 mol of silver, the mixing ratio being obtained based on the supply rate, was 0.30 mol. The polyvinyl alcohol content of the dispersant was 5% by mass with respect to the amount of silver in the reaction solution at the time of mixing. Moreover, after the supply of the silver solution and the reductant solution was completed, stirring in the receiving tank was continued for 30 minutes.

The silver solution obtained after the completion of the stirring was filtered by using a membrane filter having an opening diameter of 0.1 μm, whereby silver particles were solid-liquid separated. Subsequently, the collected silver particles were fed into 4 L of a 0.01 mol/L NaOH solution and stirred for 15 minutes, and then filtered and collected by using a membrane filter having an opening diameter of 0.1 μm. An operation comprising the feeding into the NaOH solution, the stirring, and the filtration was further repeated twice, and then the collected silver particles were fed into 4 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.54 μm, the diameter being measured by SEM observation; a value obtained by dividing the standard deviation of particle diameter by the average particle diameter was 0.30; and hence the silver powder was good as a silver powder for pastes.

Example 9

In a hot bath at a temperature of 38 degrees C., while being stirred, 1477 g of silver chloride (manufactured by Sumitomo Metal Mining Co., Ltd., 99.9999% purity, 11.7% moisture content) was fed into 18.66 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 13 ml of this diluted solution of defoaming agent was added to the prepared silver solution, then the obtained silver solution was maintained at 36 degrees C. in a hot bath.

Next, 1018 g of ascorbic acid (reagent, manufactured by KANTO CHEMICAL Co., Inc.) as a reductant was dissolved in 2 L of pure water having a temperature of 30 degrees C. Furthermore, 216 g of polyvinyl alcohol (PVA205, manufactured by KURARAY Co., Ltd.) as a dispersant was dissolved in 5.79 L of pure water having a temperature of 36 degrees C. These two solutions were mixed to prepare a reductant solution, and said reductant solution was adjusted to have a temperature of 36 degrees C.

By using a smoothflow pump (APL-5, BPL-2, manufactured by TACMINA CORPORATION), the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 180 degrees with a supply direction of the silver solution. In order to completely terminate a reduction reaction during solution transfer, a soft polyvinylchloride resin tube having an insider diameter of 12 mm and a length of 3.6 m was connected to the outlet side of the reaction pipe, whereby the reaction solution was transferred to the receiving tank. At this point, the reduction rate was 128 g/minute in the amount of silver, and the silver concentration in the reaction solution was 35.5 g/L. Furthermore, the mixing ratio of ascorbic acid with respect to 1 mol of silver, the mixing ratio being obtained based on the supply rate, was 0.50 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered using a by filter press, whereby silver particles were solid-liquid separated. Subsequently, the collected silver particles were fed into 25 L of a 0.01 mol/L NaOH solution and stirred for 15 minutes, and then filtered and collected by using a filter press. An operation comprising the feeding into the NaOH solution, the stirring, and the filtration was further repeated twice, and then the collected silver particles were fed into 25 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.99 μm, the diameter being measured by SEM observation; a value obtained by dividing the standard deviation of particle diameter by the average particle diameter was 0.28; and the silver powder had high dispersibility, hence the silver powder was good as a silver powder for pastes. Furthermore, the concentration of chlorine contained in the silver powder was analyzed in the same manner as in Example 1, and a result, the chlorine concentration was 39 ppm, and it was thus confirmed that a silver powder having a small chlorine content, namely, a chlorine concentration of less than 40 ppm, was able to be produced.

Example 10

In a hot bath heated by a hot-water jacket having a temperature of 38 degrees C., while being stirred, 2272 g of silver chloride (manufactured by Sumitomo Metal Mining Co., Ltd., 99.9999% purity, 11.7% moisture content) was fed into 18.66 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 20 ml of this diluted solution of defoaming agent was added to the prepared silver solution, then the obtained silver solution was maintained at 36 degrees C. in a hot bath.

Next, 1566 g of ascorbic acid (reagent, manufactured by KANTO CHEMICAL Co., Inc.) as a reductant was dissolved in 2 L of pure water having a temperature of 30 degrees C. Furthermore, 332 g of polyvinyl alcohol (PVA205, manufactured by KURARAY Co., Ltd.) as a dispersant was dissolved in 5.79 L of pure water having a temperature of 36 degrees C. These two solutions were mixed to prepare a reductant solution, and said reductant solution was adjusted to have a temperature of 36 degrees C.

Using a smoothflow pump (APL-5, BPL-2, manufactured by TACMINA CORPORATION), the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 180 degrees with a supply direction of the silver solution. In order to completely terminate a reduction reaction during solution transfer, a soft polyvinylchloride resin tube having an insider diameter of 12 mm and a length of 3.6 m was connected to the outlet side of the reaction pipe, whereby the reaction solution was transferred to the receiving tank. At this point in time, the reduction rate was 196 g/minute in the amount of silver, and the silver concentration in the reaction solution was 54.5 g/L. Furthermore, the mixing ratio of ascorbic acid with respect to 1 mol of silver, the mixing ratio being obtained based on the supply rate, was 0.50 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 25 L of a 0.01 mol/L NaOH solution and stirred for 15 minutes, and then filtered and collected, by using a filter press. An operation comprising the feeding into the NaOH solution, the stirring, and the filtration was further repeated twice, and then the collected silver particles were fed into 25 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 1.30 μm, the diameter being measured by SEM observation; a value obtained by dividing the standard deviation of particle diameter by the average particle diameter was 0.29; and the silver powder had high dispersibility, hence the silver powder was good as a silver powder for pastes.

Example 11

In a hot bath heated by a hot-water jacket having a temperature of 38 degrees C., while being stirred, 2277 g of silver chloride (manufactured by Sumitomo Metal Mining Co., Ltd., 99.9999% purity, 11.7% moisture content) was fed into 14.38 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 20 ml of this diluted solution of defoaming agent was added to the prepared silver solution, then the obtained silver solution was maintained at 36 degrees C. in a hot bath.

Next, 972 g of ascorbic acid (reagent, manufactured by KANTO CHEMICAL Co., Inc.) as a reductant was dissolved in 4.12 L of pure water having a temperature of 30 degrees C. Furthermore, 343 g of polyvinyl alcohol (PVA205, manufactured by KURARAY Co., Ltd.) as a dispersant was dissolved in 2.08 L of pure water having a temperature of 36 degrees C. These two solutions were mixed to prepare a reductant solution, and said reductant solution was adjusted to have a temperature of 36 degrees C.

By using a smoothflow pump (APL-5, BPL-2, manufactured by TACMINA CORPORATION), the silver solution and the reductant solution were supplied to a reaction pipe at 2.1 L/minute and 0.7 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 180 degrees with a supply direction of the silver solution. In order to completely terminate a reduction reaction during solution transfer, a soft polyvinylchloride resin tube having an insider diameter of 12 mm and a length of 3.6 m was connected to the outlet side of the reaction pipe, whereby the reaction solution was transferred to the receiving tank. At this point, the reduction rate was 199 g/minute in the amount of silver, and the silver concentration in the reaction solution was 71.0 g/L. Furthermore, the mixing ratio of ascorbic acid with respect to 1 mol of silver, the mixing ratio being obtained based on the supply rate, was 0.30 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 25 L of a 0.01 mol/L NaOH solution and stirred for 15 minutes, and then filtered and collected by using a filter press. An operation comprising the feeding into the NaOH solution, the stirring, and the filtration was further repeated twice, and then the collected silver particles were fed into 25 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 1.40 μm, the diameter being measured by SEM observation; a value obtained by dividing the standard deviation of particle diameter by the average particle diameter was 0.22; and the silver powder had high dispersibility, hence the silver powder was good as a silver powder for pastes.

Comparative Example 1

In a hot bath having a temperature of 38 degrees C., 2242 g of silver chloride (manufactured by Sumitomo Metal Mining Co., Ltd., 99.9999% purity, 10.6% moisture content) was fed into 14.34 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 20 ml of this diluted solution of defoaming agent was added to the prepared silver solution, then the obtained silver solution was maintained at 36 degrees C. in a hot bath.

Next, 948 g of ascorbic acid (reagent, manufactured by KANTO CHEMICAL Co., Inc.) as a reductant was dissolved in 4 L of pure water having a temperature of 30 degrees C. Furthermore, 111 g of polyvinyl alcohol (PVA205, manufactured by KURARAY Co., Ltd.) as a dispersant was dissolved in 2.03 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.6 L/minute and 1.1 L/minute, respectively, and, while being stirred, the reaction solution discharged from the reaction pipe was kept in a receiving tank. As the reaction pipe, a Y-shaped pipe having an inside diameter of 10 mm was used, and an angle which a pipe to supply the silver solution formed with a pipe to supply the reductant solution was made to be 60 degrees. In order to completely terminate a reduction reaction during solution transfer, a soft polyvinylchloride resin tube having an insider diameter of 12 mm and a length of 1 m was connected to the outlet side of the reaction pipe, whereby the reaction solution was transferred to the receiving tank. At this point, the reduction rate was 300 g/minute in the amount of silver, and the silver concentration in the reaction solution was 81.0 g/L. Furthermore, the mixing ratio of ascorbic acid with respect to 1 mol of silver, the mixing ratio being obtained based on the supply rate, was 0.30 mol. The polyvinyl alcohol content of the dispersant was 7% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a filter press, whereby silver particles were solid-liquid separated. Subsequently, the collected silver particles were fed into 20 L of a 0.01 mol/L NaOH solution and stirred for 15 minutes, and then filtered and collected by using a filter press. An operation comprising the feeding into the NaOH solution, the stirring, and the filtration was further repeated twice, and then the collected silver particles were fed into 20 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter of 0.45 μm, the diameter being measured by SEM observation, but, a value obtained by dividing the standard deviation of particle diameter by the average particle diameter was 0.49, and thus a particle size distribution was broad and coarse particles were formed. The silver powder obtained in Comparative Example 1 had a considerably lower dispersibility of particle diameter, compared with the silver powders in the above-mentioned Examples 1 and 2, and thus it cannot be said that the silver powder was good as a silver powder for pastes. It should be noted that the concentration of chlorine contained in the silver powder was analyzed in the same manner as in Example 1, and a result, the chlorine concentration was 28 ppm.

Comparative Example 2

In a hot bath having a temperature of 38 degrees C., 49 g of silver chloride (manufactured by Sumitomo Metal Mining Co., Ltd., 99.9999% purity, 10.55% moisture content) was fed into 7.35 L of 25%-by-mass ammonia water maintained at a liquid temperature of 36 degrees C., whereby a silver solution was prepared. A defoaming agent (ADEKANOL LG-126, manufactured by ADEKA Corp.) was diluted 100 times at a volume ratio, and 0.4 ml of this diluted solution of defoaming agent was added to the prepared silver solution, then the obtained silver solution was maintained at 36 degrees C. in a hot bath.

Next, 21 g of ascorbic acid (reagent, manufactured by KANTO CHEMICAL Co., Inc.) as a reductant was dissolved in 1.0 L of pure water having a temperature of 30 degrees C. Furthermore, 7 g of polyvinyl alcohol (PVA205, manufactured by KURARAY Co., Ltd.) as a dispersant was dissolved in 1.71 L of pure water having a temperature of 50 degrees C. These two solutions were mixed to prepare a reductant solution, and said reductant solution was adjusted to have a temperature of 36 degrees C.

By using a tube pump, the silver solution and the reductant solution were supplied to a reaction pipe at 2.7 L/minute and 0.9 L/minute, respectively, and, while being stirred, the reaction solution discharged from the reaction pipe was kept in a receiving tank. As the reaction pipe, there was used a glass concentric pipe configured to mix and stir both of the solutions (silver solution supply pipe: 10.0 mm in inside diameter, reductant solution supply pipe: 3.6 mm in inside diameter, mixing pipe: 100 mm in length), wherein a supply direction of the reductant solution formed an angle of 0 degrees with a supply direction of the silver solution. In order to completely terminate a reduction reaction during solution transfer, a soft polyvinylchloride resin tube having an insider diameter of 12 mm and a length of 10 m was connected to the outlet side of the reaction pipe, whereby the reaction solution was transferred to the receiving tank. At this point, the reduction rate was 11 g/minute in the amount of silver, and the silver concentration in the reaction solution was 3.0 g/L. Furthermore, the mixing ratio of ascorbic acid with respect to 1 mol of silver, the mixing ratio being obtained based on the supply rate, was 0.35 mol. The polyvinyl alcohol content of the dispersant was 17% by mass with respect to the amount of silver in the reaction solution at the time of mixing. Moreover, after the supply of the silver solution and the reductant solution was completed, stirring in the receiving tank was continued for 60 minutes.

The silver solution obtained after the completion of the stirring was filtered by using a membrane filter having an opening diameter of 0.1 μm, whereby silver particles were solid-liquid separated. Subsequently, the collected silver particles were fed into 0.8 L of a 0.01 mol/L NaOH solution and stirred for 15 minutes, and then filtered and collected by using a membrane filter having an opening diameter of 0.1 μm. An operation comprising the feeding into the NaOH solution, the stirring, and the filtration was further repeated twice, and then the collected silver particles were fed into 0.8 L of pure water, and an operation comprising stirring and filtration was performed. After the filtration, the silver particles were moved to a stainless steel pad, and, by using a vacuum dryer, dried at 60 degrees C. for 15 hours, whereby a silver powder was obtained.

The obtained silver powder was observed by a scanning electron microscope (SEM), and as a result, it was confirmed that the silver powder had an average particle diameter, measured by SEM observation, of 0.28 μm and thus contains very minute particles, and furthermore, a value obtained by dividing the standard deviation of particle diameter by the average particle diameter was 0.35 and thus a particle size distribution was broad. The silver powder obtained in Comparative Example 2 had a considerably lower dispersibility of particle diameter, compared with the silver powder in Example 3, and thus it cannot be said that the silver powder was good as a silver powder for paste.

The following Table 1 collectively shows production conditions and evaluation results about a silver powder obtained in each of Examples and Comparative Examples. It should be noted that "PVA concentration" in Table 1 represents a concentration of polyvinyl alcohol added as a dispersant in a reductant solution in advance with respect to a silver amount in a reaction solution after the mixing. "SM" represents a static mixer installed in a mixing pipe. "Flowing-through time" represents a time elapsed from the mixing of a silver solution with a reductant solution in a flow path until the mixed solution flows down through the flow path and reaches an outlet (receiving tank).

TABLE 1

| | Conditions | | | | | | | | |
|---|---|---|---|---|---|---|---|---|---|
| | | | | | | | | Reaction pipe | |
| | Silver solution | | Reducing solution | | | | | | Supply |
| | Silver | | Ascorbic acid | | | | | | angle of |
| | concentration g/L | Flow rate L/minute | Concentration g/L | mol/ 1-mol-Ag | Equivalent | PVA concentration % | Flow rate L/minute | Type | reducing solution |
| Example 1 | 33 | 2.4 | 56 | 0.35 | 1.4 | 17 | 0.8 | Y-shaped pipe | 60° |
| Example 2 | 45 | 2.4 | 78 | 0.35 | 1.4 | 17 | 0.8 | Y-shaped pipe | 60° |
| Example 3 | 7 | 2.7 | 11 | 0.35 | 1.4 | 17 | 0.9 | Concentric pipe with solution supplies in the ame direction | 0° |
| Example 4 | 16 | 2.7 | 27 | 0.35 | 1.4 | 17 | 0.9 | Concentric pipe with solution supplies in the same direction | 0° |
| Example 5 | 35 | 2.7 | 61 | 0.35 | 1.4 | 17 | 0.9 | Concentric pipe with solution supplies in the same direction | 0° |
| Example 6 | 53 | 2.7 | 92 | 0.35 | 1.4 | 17 | 0.9 | Concentric pipe with solution supplies in the same direction | 0° |
| Example 7 | 95 | 0.24 | 139 | 0.30 | 1.2 | 5 | 0.08 | Gutter | 90° |
| Example 8 | 47 | 2.1 | 70 | 0.30 | 1.2 | 5 | 0.7 | Gutter | 90° |
| Example 9 | 47 | 2.7 | 116 | 0.50 | 2.0 | 17 | 0.9 | Concentric pipe with solution supplies in the opposite direction | 180° |
| Example 10 | 73 | 2.7 | 178 | 0.50 | 2.0 | 17 | 0.9 | Concentric pipe with solution supplies in the opposite direction | 180° |
| Example 11 | 95 | 2.1 | 139 | 0.30 | 1.2 | 17 | 0.7 | Concentric pipe with solution supplies in the opposite direction | 180° |
| Comparative Example 1 | 426 | 2.6 | 493 | 0.30 | 1.2 | 7 | 1.1 | Y-shaped pipe | 60° |

TABLE 1-continued

| | | | | | | | | | |
|---|---|---|---|---|---|---|---|---|---|
| Comparative Example 2 | 14 | 2.7 | 25 | 0.35 | 1.4 | 17 | 0.9 | Concentric pipe with solution supplies in the same direction | 0° |

| | Conditions | | | | | | | Evaluation results | | |
|---|---|---|---|---|---|---|---|---|---|---|
| | Reaction pipe | | Reducing pipe | | | Reaction solution | | Particle diameter | | |
| | SM | Inside diameter mm | Inside diameter mm | Length m | Flowing-through time s | Velocity g/minute | [Ag] g/L | Average μm | σ/Ave. | [Cl] ppm |
| Example 1 | with | 10 | 12 | 10 | 45 | 78 | 24.5 | 0.79 | 0.15 | 22 |
| Example 2 | with | 10 | 12 | 10 | 45 | 109 | 34.0 | 1.01 | 0.16 | 19 |
| Example 3 | without | 10 | 12 | 10 | 50 | 18 | 5.0 | 0.39 | 0.20 | 23 |
| Example 4 | without | 10 | 12 | 10 | 50 | 42 | 11.8 | 0.54 | 0.21 | 35 |
| Example 5 | without | 10 | 12 | 10 | 50 | 95 | 26.5 | 0.91 | 0.15 | 20 |
| Example 6 | without | 10 | 12 | 10 | 50 | 14.4 | 40.1 | 1.18 | 0.23 | — |
| Example 7 | without | 13 | 13 | 1 | 15 | 23 | 71.0 | 0.73 | 0.29 | — |
| Example 8 | without | 25 | 25 | 1 | 15 | 100 | 35.5 | 0.54 | 0.30 | — |
| Example 9 | without | 10 | 12 | 3.6 | 20 | 128 | 35.5 | 0.99 | 0.28 | 39 |
| Example 10 | without | 10 | 12 | 3.6 | 20 | 196 | 54.5 | 1.30 | 0.29 | — |
| Example 11 | without | 10 | 12 | 3.6 | 25 | 199 | 71.0 | 1.40 | 0.22 | — |
| Comparative Example 1 | without | 10 | 12 | 1 | 5 | 300 | 81.0 | 0.45 | 0.49 | 28 |
| Comparative Example 2 | without | 10 | 12 | 10 | 50 | 11 | 3.0 | 0.28 | 0.35 | — |

The invention claimed is:

1. A method for producing a silver powder, the method comprising:

quantitatively and continuously supplying each of a silver solution containing a silver complex and a reductant solution to a flow path; and quantitatively and continuously reducing a silver complex in a reaction solution obtained by mixing the silver solution with the reductant solution in the flow path, wherein the silver solution is obtained by dissolving silver chloride in ammonia water, and the reaction solution is made to contain a dispersant, and a silver concentration in the reaction solution is adjusted to be in a range of 5 to 75 g/L.

2. The method for producing a silver powder according to claim 1, wherein a particle size of silver particles formed by reduction is controlled by adjusting a silver concentration in the reaction solution.

3. The method for producing a silver powder according to claim 1, wherein the reductant is ascorbic acid, and a mixing ratio of the reductant with respect to 1 mol of silver at a time of mixing the reductant solution with the silver solution is 0.25 to 0.50 mol.

4. The method for producing a silver powder according to claim 1, wherein, as a dispersant, at least one selected from the group consisting of polyvinyl alcohol, polyvinyl pyrrolidone, a denatured silicone oil surface active agent, and a polyether surface active agent is added to the reductant solution.

5. The method for producing a silver powder according to claim 1, wherein mixing is performed while an angle which a supply direction of the reductant solution forms with a supply direction of the silver solution in the flow path is not less than 0 degrees and not more than 90 degrees in a plane including the supply directions of both of the solutions.

6. The method for producing a silver powder according to claim 5, wherein piping configured to supply the reductant solution is arranged inside and on the same axis as piping configured to supply the silver solution, and the silver solution and the reductant solution are made to flow in a same direction.

7. The method for producing a silver powder according to claim 5, wherein a reaction solution obtained by mixing the silver solution with the reductant solution in the flow path is homogenized by using a static mixer.

8. The method for producing a silver powder according to claim 5, wherein a supply pipe of silver solution and a supply pipe of reductant solution are arranged in an upper part of a pipe inclined with respect to a horizontal plane, whereby the silver solution and the reductant solution are supplied in such a way that a flow of the silver solution and a flow of the reductant solution intersect each other.

9. The method for producing a silver powder according to claim 1, wherein mixing is performed while an angle which a supply direction of the reductant solution forms with a supply direction of the silver solution in the flow path is more than 90 degrees and not more than 180 degrees in a plane including the supply directions of both of the solutions.

10. The method for producing a silver powder according to claim 9, wherein piping configured to supply the reductant solution is installed inside and on the same axis as piping configured to supply the silver solution, and the silver solution and the reductant solution are made to flow in opposite directions facing each other.

11. The method for producing a silver powder according to claim 1, wherein a time elapsed from mixing of the silver solution with the reductant solution in the flow path until a mixed solution flows down through the flow path and reaches an outlet is not less than 15 seconds and not more than 60 seconds.

12. The method for producing a silver powder according to claim 1, wherein a reaction solution obtained by mixing in the flow path is kept and stirred in a receiving tank arranged at an end of the flow path.

* * * * *